United States Patent [19]

Stephanoff

[11] 3,945,130

[45] Mar. 23, 1976

[54] EXPANDED CHAMBER CENTRIFUGAL DRYING MILL

[75] Inventor: Nicholas N. Stephanoff, Haverford, Pa.

[73] Assignee: Fluid Energy Processing & Equipment Co., Hatfield, Pa.

[22] Filed: Jan. 10, 1975

[21] Appl. No.: 540,136

[52] U.S. Cl. ..... 34/10; 34/12; 34/57 E

[51] Int. Cl.[2] ..... F26B 3/08; F26B 17/10

[58] Field of Search ..... 34/10, 12, 57 R, 57 B, 34/57 E

[56] References Cited

UNITED STATES PATENTS

| | | | |
|---|---|---|---|
| 3,667,131 | 6/1972 | Stephanoff | 34/10 |
| 3,814,316 | 6/1974 | Stephanoff | 34/10 |

*Primary Examiner*—John J. Camby

*Attorney, Agent, or Firm*—Arthur A. Jacobs

[57] ABSTRACT

A centrifugal drying mill for wet particles comprising an inlet chamber, an upstack leading from one end of the inlet chamber, a classification section connected to the upstack and a downstack leading from the classification section to the opposite end of the inlet chamber to form a generally arcuate centrifugal path, and an exhaust port between the classification section and downstack. The inlet chamber which has tangential nozzles leading into it from a source of hot gaseous fluid is enlarged relative to the remainder of the mill to effect a deceleration and circulation of the incoming particles in the inlet chamber simultaneously with movement of the circulating mass through the inlet chamber toward the upstack.

12 Claims, 5 Drawing Figures

EXPANDED CHAMBER CENTRIFUGAL DRYING MILL

This invention relates to a drying mill of the centrifugal fluid type, and it particularly relates to a drying mill of the aforesaid type which is specially adapted to be built in a small size that has not heretofore been possible with this type of mill.

Drying mills of this type comprise an inlet chamber which is adapted to receive wet particles, such as a slurry or the like, and which is provided with a series of angular gaseous fluid inlet nozzles connected to a source of hot gaseous fluid. The wet particles are fed into one end of the inlet chamber, preferably in the form of an atomized spray, and are entrained in the gaseous fluid. The opposite end of the inlet chamber is connected to an upstack which is itself connected to a classification section. The classification section is connected to a downstack which leads into the inlet chamber adjacent the particle feed inlet. Between the classification section and the downstack, on the inner periphery, is an exhaust port. The upstack, classification section and downstack form a generally arcuate path.

As the particles are entrained in the hot angularly-directed gases, they are whirled in a centrifugal action through the generally arcuate path leading from the upstack to the classification section, at which time a large proportion of the particles are completely dried while some are only partially dried. The completely dried particles, being lighter, whirl around in the inner portion of the centrifugal path while the less dry particles, being heavier, whirl around in the outer portion of the centrifugal path. Such separation or classification is effected primarily in the classification section, so that as the particles descend into the downstack, the lighter particles in the inner centrifugal portion pass through the exhaust port while the heavier particles pass down through the downstack into the inlet chamber where they mix with fresh feed and are again entrained by the hot gaseous fluid and recycled through the mill.

Although the above-described mill is highly effective for most materials, it has not heretofore been possible to reduce the size of the mill to make it economically feasible for the treatment of small batches or for laboratory or testing purposes. One reason was that a small inlet, or primary drying, chamber did not permit sufficient time in the chamber to dry a large portion of the particles because there was not sufficient dispersion of the particles before they passed out of the chamber to let the heated gases reach the interfaces of adjacent particles which became agglomerated by the moisture at these interfaces. On the other hand, the intense heat in the chamber acted to rapidly case-harden the exposed surfaces of the particles so that the heat never penetrated the interior of these particles, with the result that the interior was never dried. Furthermore, the short length of the inlet chamber caused many of the particles, particularly when they were propelled into the chamber in an atomized spray, to be thrown against the chamber walls by the gases before they could pass out of the chamber, thereby causing a build-up in the chamber and eventual clogging of the mill.

It is one object of the present invention to provide an effective small centrifugal drying mill which overcomes the above difficulties by providing sufficient time for the particles in the inlet chamber to effect thorough drying of the bulk of the particles while preventing case-hardening and while substantially preventing the particles from sticking to the mill walls.

Another object of the present invention is to provide a mill of the aforesaid type which is simple in construction, economical in cost and easy to operate and maintain.

Other objects and many of the attendant advantages of this invention will be readily appreciated as the same becomes better understood by reference to the following description when read in conjunction with the accompanying drawings wherein.

Figure 1:
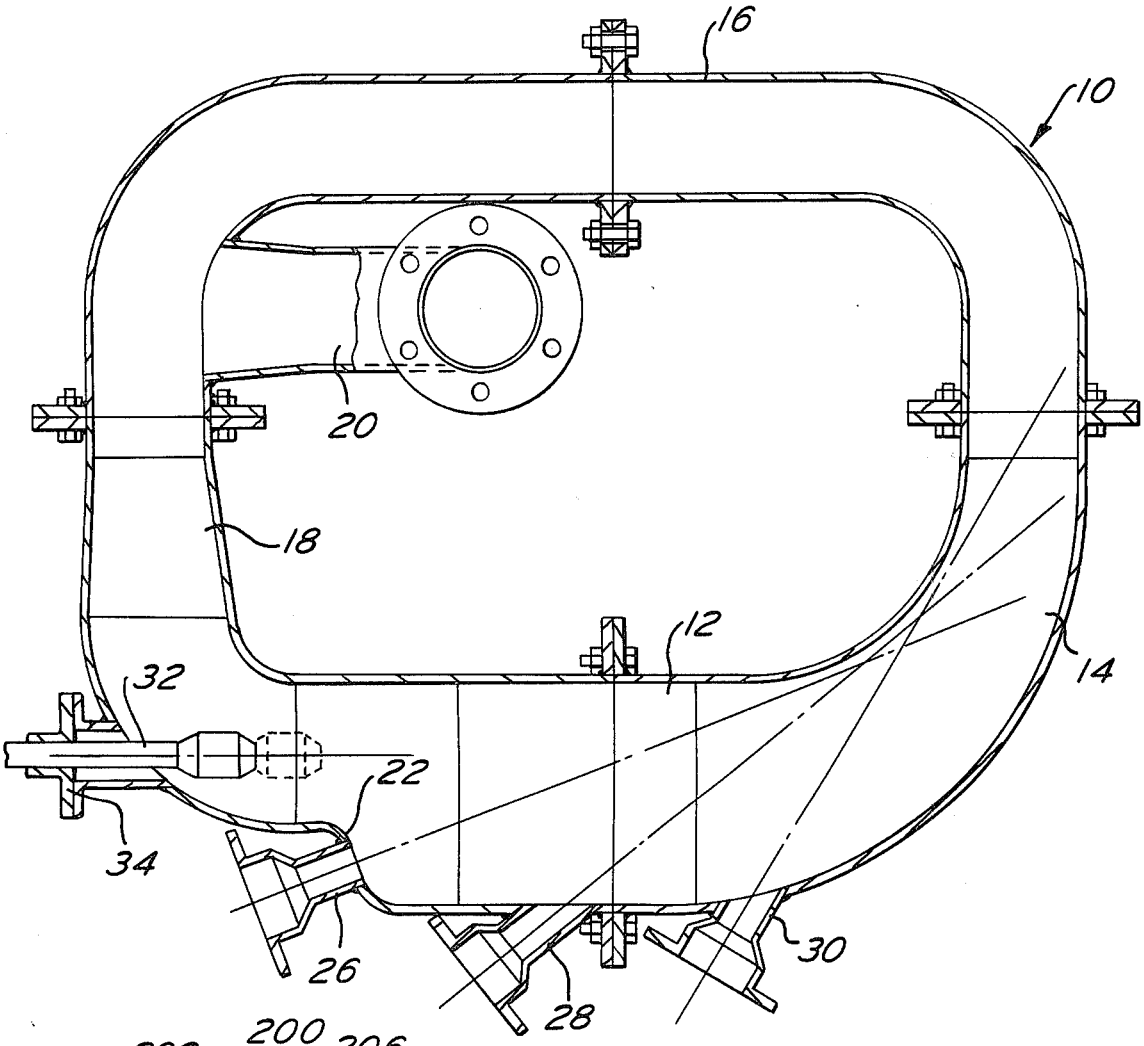
FIG. 1 is a side sectional view showing a drying mill embodying the present invention.

Referring now in greater detail to the figures of the drawings wherein similar reference characters refer to similar parts, there is shown a drying mill, generally designated 10, having an inlet or drying chamber 12, an upstack 14, a classification section 16 and a downstack 18. An exhaust port 20 is provided between the classification section 16 and downstack 18.

Figure 2:
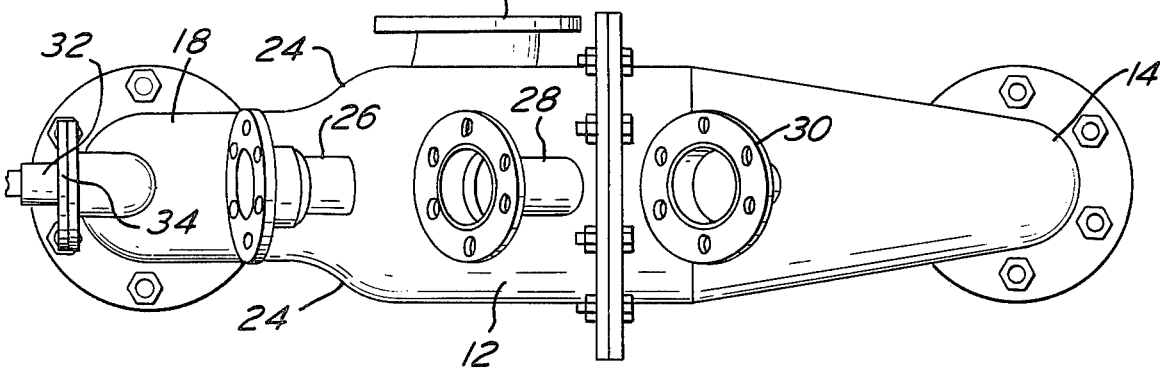
FIG. 2 is a bottom elevational view of the mill of FIG. 1.
Figure 3:
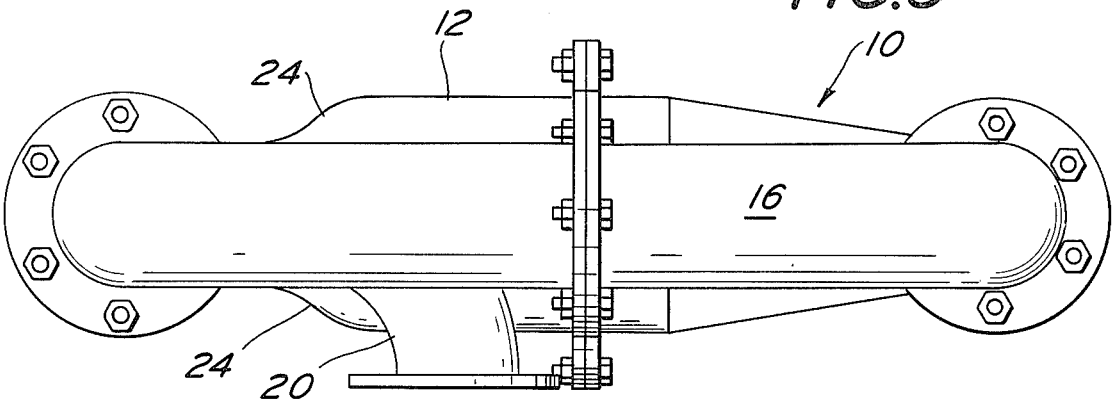
FIG. 3 is a top elevational view of the mill of FIG. 1.

The inlet chamber 12 tapers downwardly and laterally from the upstack, as best seen in FIGS. 1 and 2, and is provided at its opposite end with an abrupt shoulder portion which connects it to the lower end of the downstack 18, this shoulder portion being indicated both in the vertical, as shown in FIG. 1 at 22 and in the horizontal, as shown in FIG. 2 at 24. A plurality of gaseous fluid nozzles here shown as three in number and respectively designated 26, 28 and 30, extend from a source of hot gaseous fluid under pressure such as a manifold or the like (not shown) into the bottom wall of the chamber 12. These nozzles are arranged at varying angles to effect a convergence of the direct paths of their gaseous fluid streams in the bottom portion of the upstack 14. The nozzle 26 is positioned in the offset formed by shoulder 22, while the nozzle 30 is arranged to direct its stream into the upstack 14.

An important feature of the present invention is the provision of the feed inlet 32 at the elbow portion of the downstack, upstream from the nozzle 26. This feed inlet may be of any feasible type but is preferably of the type which projects an atomized spray. The inlet shown is a spray nozzle connected to a source of gaseous fluid under pressure (not shown) and is longitudinally adjustable in the sleeve 34. The atomized stream from nozzle 32 is projected in the horizontal or axial direction into the chamber 12. The upstream positioning of this feed inlet permits the ejected atomized spray to be initially entrained in the gaseous fluid passing down from the downstack. This gaseous fluid is relatively cool and somewhat moist because a large proportion of the heat has been given up during the endothermic drying process in the inlet chamber and the subsequent passage through the upstack, classification section and downstack, while a small amount of condensation usually takes place. Therefore, the relatively cool, somewhat moist gas acts as a tempering means to prevent overly rapid drying and case-hardening of the exposed surfaces of the particles when they move into the hot gaseous streams from the nozzles 26, 28 and 30.

Another important feature is the positioning of the nozzle 26 at the shoulder 22, 24 because this prevents the formation of a partial vacuum at the shoulder which could induce vortex action at that area. The sudden expansion of the inlet chamber 12 downstream from the shoulder portion 22,24 results in what is, in effect, a reverse or back pressure, causing the individual particles to slow down and circulate within the chamber 12. This not only thoroughly disperses the particles but permits them to remain in the chamber for a longer period of time than would otherwise be the case so that the individual particles are subjected to the hot gases for a longer period of time and, consequently, are more thoroughly dried. At the same time, the circulating mass continues to move through the chamber 12 into the upstack 14 under the influence of the gaseous streams from the nozzles 26, 28 and 30.

Figure 4:
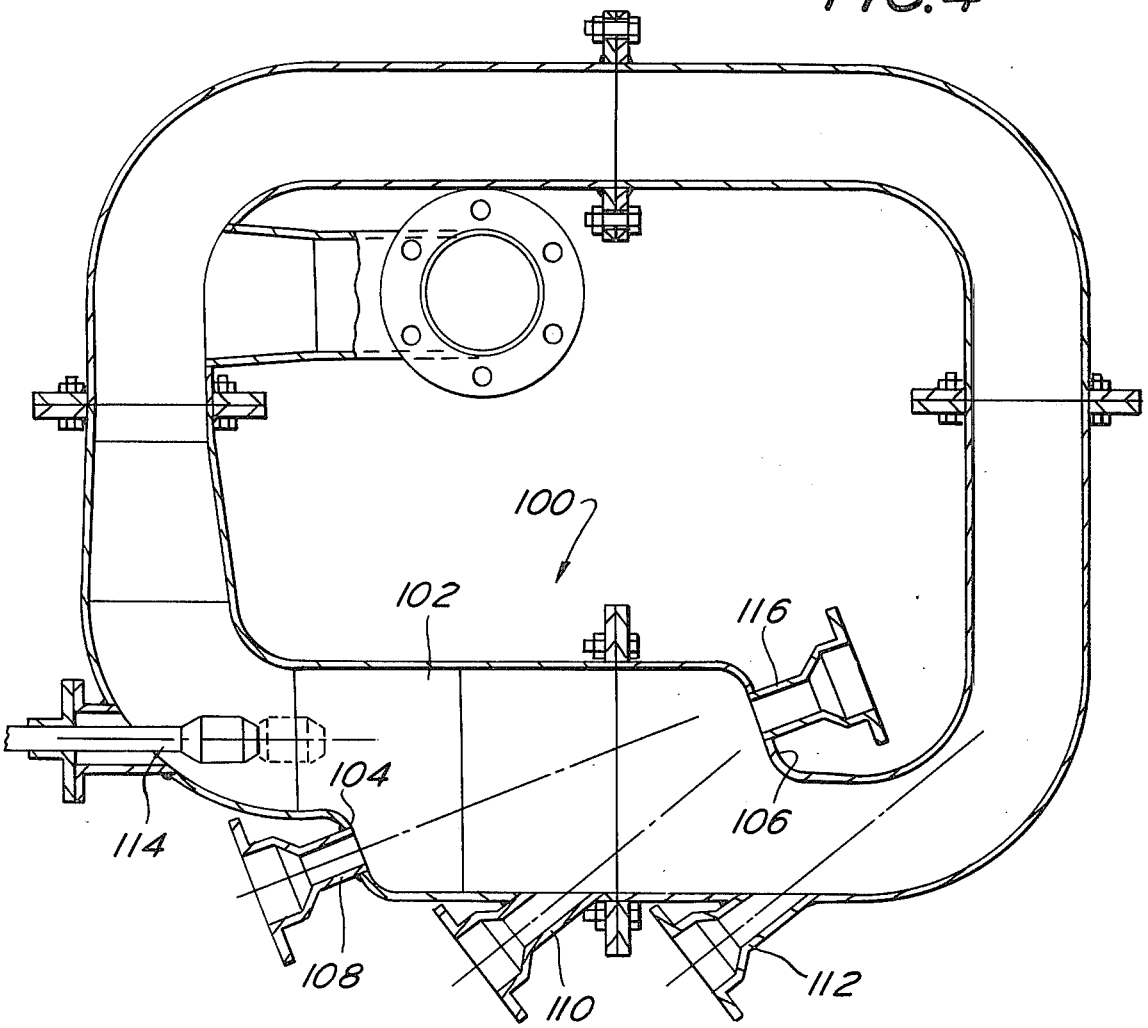
FIG. 4 is a side sectional view of a modified form of the mill of FIG. 1.

In FIG. 4 there is shown a modified form, generally designated 100, of the above-described mill. In this mill, the upper parts are the same as in FIG. 1, but the inlet or drying chamber 102 is modified in that a shoulder portion, similar to that shown at 22 and 24 in FIGS. 1 and 2, is provided at both ends of the chamber, these shoulder portions being indicated at 104 and 106 respectively.

In this form of the invention, the same type gaseous fluid nozzles, indicated at 108, 110 and 112, are provided as well as the same type of feed inlet at 114. However, in the shoulder portion 106 is provided a gaseous fluid nozzle 116 which is arranged to project a gaseous fluid stream into the chamber 102 in countercurrent to the spray from inlet 114 and the nozzles 108, 110 and 112. The pressure of the fluid from nozzle 116 is preferably made just sufficient to effect a further slowing down of the circulating mass, thereby effecting a larger duration of the particles in the chamber and a more thorough dispersal. This type of mill is utilized with certain materials which, by their nature, require this greater dispersal and longer drying time.

Although the nozzle 116 is shown as being supplied with gaseous fluid under pressure from a source (not shown), it may, optionally, be connected to the downstream portion of the downstack to receive its gaseous fluid from there.

It is also possible to construct the inlet chamber so that the shoulder 116 is in the bottom wall the same as the shoulder 104 or to make both in the upper wall, or to reverse the positions of the shoulders, if so desired. However, the constructions shown and described are the preferred constructions for the desired results.

Figure 5:
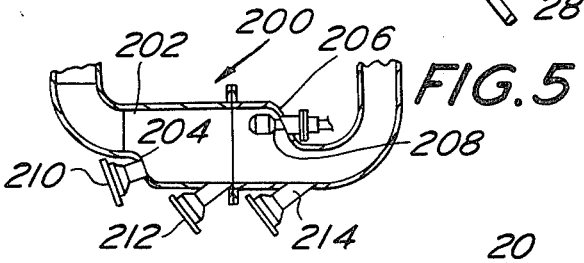
FIG. 5 is a fragmentary side view of a further modification of the mill.

FIG. 5 shows another embodiment of the invention wherein the parts are generally the same as described above except that in this form of the mill, generally designated 200, the inlet or drying chamber 202, which is otherwise similar to chamber 102 in FIG. 4 in that it has opposed shoulders indicated at 204 and 206, has the feed inlet nozzle 208 extending through shoulder 206 so that the spray therefrom is in countercurrent to the streams of hot gaseous fluid from nozzles 210, 212 and 214. By this construction, the spray from nozzle 208 serves both as a feed inlet and as a decelerating force in the same manner as the fluid from nozzle 116.

It is also within the scope of the present invention to utilize a construction such as shown in FIG. 5, with the feed inlet in countercurrent to the hot gaseous streams, but to eliminate the shoulder 204 between the downstack and the inlet chamber 202.

The invention claimed is:

1. A centrifugal drying mill for wet particles comprising a generally arcuate housing including an inlet chamber, an upstack connected to one end of said chamber, a classification section connected to said upstack and a downstack connected to said classification section, said downstack being connected to the opposite end of said chamber, an exhaust port leading from the inner periphery of said housing between said classification section and said downstack, and a feed inlet being positioned to project wet particles into said inlet chamber in the substantially axial direction of said inlet chamber, said inlet chamber having a substantially larger cross-sectional internal area than said upstack and downstack and having at least one wall thereof abruptly offset from the adjacent end of said downstack by a shoulder portion, said shoulder portion being substantially perpendicular to the adjacent walls of said inlet chamber and said downstack, said inlet chamber having a plurality of gaseous fluid nozzles arranged to propel hot gaseous fluid into said inlet chamber at predetermined angles in such manner that the streams of hot gaseous fluid therefrom are directed toward said upstack.

2. The mill of claim 1 wherein one of said gaseous fluid nozzles is positioned at said shoulder portion.

3. The mill of claim 1 wherein said inlet chamber has at least one wall thereof offset from the adjacent end of said upstack by a second abrupt shoulder portion.

4. The mill of claim 3 wherein said feed inlet is constructed and arranged to project the fed material toward said upstack and wherein a gaseous fluid nozzle is positioned at said second shoulder portion to propel gaseous fluid into said inlet chamber in countercurrent to said fed material and to the streams of hot gaseous fluid from said first-mentioned gaseous fluid nozzles.

5. The mill of claim 3 wherein said feed inlet is positioned at said second shoulder portion to project the fed material in countercurrent to the streams of hot gaseous fluid from said gaseous fluid nozzles.

6. The mill of claim 1 wherein said feed inlet is positioned upstream of said gaseous fluid nozzles.

7. The mill of claim 1 wherein said feed inlet is positioned to project an atomized spray of said particles into said inlet chamber.

8. In the method of drying wet particles by propelling the particles into a stream of selectively directed hot gases which subject the particles to both drying and centrifugal action whereby the particles and gases are centrifugally moved through a generally arcuate path to centrifugally separate the drier lighter particles from the less dry heavier particles, the lighter particles and a portion of said gases being centrifugally exhausted from said path while the heavier particles and another portion of said gases are returned for admixture with fresh wet particles and further subjection to the hot gases, the improvement which comprises applying a back pressure to the particles to decelerate the centrifugal movement of said particles and rotate them, prior to their subjection to the hot gases while simultaneously moving said particles into said arcuate path.

9. The method of claim 8 wherein said particles are initially propelled into said stream of hot gases as an atomized spray.

10. The method of claim 8 wherein said particles and said hot gases are propelled into said centrifugal path in one general direction while an opposed gaseous stream is directed into the path in countercurrent to said hot gases.

11. The method of claim 8 wherein said hot gases are propelled into said centrifugal path in one general direction while the particles are propelled into said centrifugal path in countercurrent to said hot gases.

12. The method of claim 8 wherein said particles have a temperature that is substantially lower than the temperature of said hot gases prior to their subjection to said hot gases whereby the heat from said hot gases is tempered when applied to said particles.

* * * * *